US008080135B2

(12) United States Patent
Abraham

(10) Patent No.: US 8,080,135 B2
(45) Date of Patent: Dec. 20, 2011

(54) METHOD AND APPARATUS FOR REMOVING SHEETS OF FIBRES FROM BANANA PLANTS FOR THE PRODUCTION OF PAPER PRODUCTS

(75) Inventor: Azer Ramy Abraham, Thebarton (AU)

(73) Assignee: Papyrus Australia Limited, Adelaide, South Australia (AU)

( * ) Notice: Subject to any disclaimer, the term of this patent is extended or adjusted under 35 U.S.C. 154(b) by 590 days.

(21) Appl. No.: 11/662,498

(22) PCT Filed: Sep. 15, 2005

(86) PCT No.: PCT/AU2005/001410

§ 371 (c)(1),
(2), (4) Date: Jan. 15, 2009

(87) PCT Pub. No.: WO2006/029469

PCT Pub. Date: Mar. 23, 2006

(65) Prior Publication Data

US 2009/0120597 A1 May 14, 2009

(30) Foreign Application Priority Data

Sep. 16, 2004 (AU) ..... 2004905315

(51) Int. Cl.
*B26D 1/00* (2006.01)

(52) U.S. Cl. ..... 162/286

(58) Field of Classification Search ..... 162/286, 162/272, 48, 99, 150; 156/512, 255; 92/3; 144/357, 365, 213
See application file for complete search history.

(56) References Cited

U.S. PATENT DOCUMENTS 1,181,553 A 5/1916 Taylor et al.
1,981,883 A 11/1934 Tappan
4,230,600 A 10/1980 Bornstein
4,269,243 A 5/1981 Hasegawa
4,547,263 A 10/1985 Quame
4,781,229 A 11/1988 Wilson
4,979,120 A 12/1990 Ely
5,141,038 A 8/1992 Nakaya (Continued)

FOREIGN PATENT DOCUMENTS

DE 100 11 232 A1 9/2000

(Continued)

OTHER PUBLICATIONS

S.K. Singhai et al., "Banana Stem Fibre for Papermaking", Indian Pulp and Paper Journal, Aug.-Sep. 1975. pp. 13-15, vol. 30(2).

(Continued)

*Primary Examiner* — Mark Halpern

(74) *Attorney, Agent, or Firm* — Nixon Peabody LLP; Jeffrey L. Costellia

(57) ABSTRACT

A method and apparatus for producing sheets from the pseudostems of banana plants in the family Musaceae, each pseudostem having a longitudinal axis. The method includes the steps of feeding a pseudostem (14) into a workstation, supporting (62, 34) the pseudostem for rotation thereof about its longitudinal axis within the workstation, and contacting the rotating pseudostem along substantially its entire length with a fibre-separating device (38), whereby a continuous sheet of fibre (60) is removed from the pseudostem by the fibre-separating device during rotation. Raw paper may also be made by laminating two or more of these sheets together such that the direction of the generally parallel fibres in at least two adjacent sheets is not aligned and then curing the sheets to form raw paper.

18 Claims, 8 Drawing Sheets

U.S. PATENT DOCUMENTS

| | | | |
|---|---|---|---|
| 5,787,949 | A | 8/1998 | Koike et al. |
| 5,927,360 | A | 7/1999 | Nakamura et al. |
| 5,958,182 | A | 9/1999 | Hondroulis et al. |
| 6,701,983 | B1 | 3/2004 | Koike |

FOREIGN PATENT DOCUMENTS

| | | |
|---|---|---|
| DE | 100 11 232 A1 | 9/2001 |
| GB | 1 431 643 | 4/1976 |
| WO | WO 00/048450 | 8/2000 |

OTHER PUBLICATIONS

J. Morton, "Banana", Fruits of Warm Climates, Miami Florida, 1987, pp. 29-46.

A. Karugaba et al., "Banana Production in Uganda", Technical Handbook No, 18, 1999, SIDA's Regional Land Management Unit.

A.R. Ennos et al., "The Functional Morphology of the Petioles of the Banana, Musa Textilis", Journal of Experimental Botany, pp. 2085-2093, vol. 51, No. 353, Dec. 2000.

N. A. Darkwa, "Plantain (Musa Paradisiaca L) Pseudostem; A Fibre Source for Tropical Countries" (1998) The 1998 Pulping Conference in Montreal Quebec, Book 2, TAPPI Press, p. 645-649.

P. Adams, "Banana Paper", Landline Australia's National Rural Affairs Weekly, Australian Broadcasting Corporation, Aug. 24, 2003 (6 pages).

R. Aedy, "Banana Paper", The Buzz, Radio National transcript, Jun. 9, 2003 (4 pages).

C.L. Chia et al., "Banana; General Crop Information", Crop Knowledge Master; www.extento.hawaii.edu/kbase/crop/crops/i_banana.htm, Mar. 31, 2004 (5 pages).

Anonymous, "Banana", Royal Botanic Gardens Kew: Information Sheet: www.rbgkew.org.uk/ksheets/banana.html, 2004 (3 pages).

R. Perez, "Feeding Pigs in the Tropics", FAU Animal Production and Health Paper 132: Chapter 5: Roots, Tubers, Bananas and Plantains; Food and Agriculture Organization of the United Nations Rome: http://www.fao.org/docrep/003/w3647e/W3647E05.htm#ch5, 1997 (19 pages).

P. Osborne et al., "Bananas", International network for the Improvement of Banana and Plantain booklet: International Plant Genetic Resources Institute 2006 (1998) (16 pages).

International Search Report for PCT/AU2005/001410 Dated Oct. 17, 2005.

(c)

(d)

METHOD AND APPARATUS FOR REMOVING SHEETS OF FIBRES FROM BANANA PLANTS FOR THE PRODUCTION OF PAPER PRODUCTS

This application is a 371 of PCT/AU2005/001410 filed on Sept. 15, 2005.

FIELD OF THE INVENTION

The present invention relates to a method and apparatus for removing sheets of fibres from banana plants in the family Musaceae under the order Scitaninae (including the two genera *Musa* and *Enseta*), such sheets being suitable for the production of paper products therefrom such as, amongst other things, raw paper for use by paper converters for the production of paper, paperboard and other paper items. The present invention further relates to the sheets (and paper products) so produced.

Although not to be limited thereto, the following description of the invention will predominantly relate to its use in producing sheets from the pseudostem of edible-fruited banana plants, such as those belonging to the species *Musa acuminata* (such as the well known bananas "Cavendish", "Lady Finger" and "Gros Michel"), *Musa balbisiana*, or to the hybrids *Musa paradisiaca* (often referred to as "plantain") and *Musa sapientum.*

BACKGROUND OF THE INVENTION

The following discussion of the background to the invention is included to explain the context of the invention. This is not to be taken as an admission that any of the material referred to was published, known or part of the common general knowledge (in any country) as at the priority date of any of the claims.

The banana plant is a large perennial herb with leaf-petiole sheaths that form generally cylindrical, trunk-like pseudostems. Each pseudostem grows from a bud on the true stem (corm), which is an underground rhizome, and can grow to heights normally in the range of 3 to 8 meters over a 9 to 18 month period. When mature, the pseudostem will comprise a soft but dense centre (a 'core') surrounded by an outer layer (a 'sheath') that is tougher but is less dense, the outer layer typically being formed by the overlapping leaf-petiole sheaths.

Commercially planted banana plants typically only have 1 to 2 year life-spans, as banana plants only flower (and produce bananas) once, following which the leaves, leaf stalks and pseudostem start to die. This usually requires their removal in some manner, such as by simply being cut down, allowing regrowth of a new pseudostem from the rhizome and the commencement of a new reproductive phase.

With annual production in 2002 of about 68 million tonnes of bananas (more than two thirds coming from within India, Brazil, China, Ecuador and the Philippines), it has been recognised that banana pseudostems represent a potentially valuable renewable resource, one which has been traditionally under-utilised and historically economically ignored by banana growers. With this in mind, there have been numerous attempts to use the pseudostems for the production of paper, due to the beneficial properties and qualities of the fibre in the pseudostems.

However, in a paper titled "Banana Stem Fibre for Papermaking" by S. K. Singhai, J. K. Garg and B. Biswas for the *Indian Pulp and Paper Journal*, August-September 1975, 30(2), pp 13 to 15, the situation at that time was summarised as "The pulping and papermaking qualities of banana (*M. sapientum* and *M. paradisica*) stem fibre have been examined. From the available information given in this paper, it is to be considered that neither technically nor economically the use of banana stem fibre is a feasible proposition." Thus, at least in the mid 70's, no sensible approach had yet been developed to the use of these materials for paper production.

Since then, it has continued to be recognised that banana pseudostem fibres should have suitable properties for paper production. In a paper titled "Plantain (*M. Paradisiaca* L) Pseudostem; A Fibre Source For Tropical Countries" by Nicholas A Darkwa of the Forestry Research Institute of Ghana, published in *Book* 2, *TAPPI Proceedings,* 1998 for the 1998 Pulping Conference in Montreal Quebec, it was concluded that " . . . tropical countries that are deficient in long-fibred material for their pulp and paper production can utilise the pseudostems of plantain and banana for such purposes."

Indeed, several attempts have been made to use banana plant refuse (predominantly pseudostems, but including leaves, leaf stalks, immature inflorescence and unused bananas) in existing or modified paper pulping processes—see U.S. Pat. No. 5,958,182 for a short summary of some such processes.

However, such refuse commonly has an extremely high water and natural latex content, and includes numerous resinous and gummy substances that are difficult to handle and process. In order to produce workable fibres having desirable characteristics for paper-making, it has proven necessary to extract these fluids and, in particular, wash out the latex and other natural resinous substances. This has proven to be technically difficult, and has generally made the pulping of banana refuse for the production of paper uneconomic, particularly for bulk paper supplies and for anything other than boutique or artistic papers. It has also generally presented the manufacturers with significant chemical waste disposal issues.

In Australia, while it has been reported that a good quality paper can be made in low volume by combining banana fibre with that of the betel nut husk (*Areca catechu* L.), Australian investigators have still concluded that the yield of banana fibre is too low for extraction to be economical. It has been reported that only 1 to 4 oz (28-113 g) of suitable fibre can be obtained from 40 to 80 lbs (18-36 kg) of green pseudostems from the pulping process. Thus, 132 tonnes of green pseudostems would yield only 1 tonne of paper. The conclusion was that the pseudostem would have much greater value as organic matter chopped and left in the field to fertilise subsequent crops.

The present invention seeks to provide a method that makes possible the use of banana plants in the family Musaceae for the production of sheets useful in the production of raw paper for subsequent conversion to paper products, ideally in a manner that is both technically simple and reasonably economic, so as to permit relatively high volume paper production therefrom.

SUMMARY OF THE INVENTION

The present inventors have determined that pulping is not the appropriate process for use in making raw paper from banana plants. Rather, they have determined that it is better to remove sheets of fibres from the plants, specifically from the pseudostems, and to use those sheets. Indeed, the present inventors have understood that these pseudostems are naturally constituted in a manner that lends itself to this by virtue of their arrangement of fibres.

However, the typically high moisture content and diverse chemical composition of pseudostems of this type renders it impossible to utilise traditional veneering and laminating techniques. The present inventors have thus developed new techniques and apparatus, which are central to the present invention.

The present invention provides a method of producing sheets from the pseudostems of banana plants in the family Musaceae, each pseudostem having a longitudinal axis, the method including the steps of:

(a) feeding a pseudostem into a workstation;
(b) supporting the pseudostem for rotation thereof about its longitudinal axis within the workstation; and
(c) contacting the rotating pseudostem along substantially its entire length with a fibre-separating device;

whereby a continuous sheet of fibre is removed from the pseudostem by the fibre-separating device during rotation.

The present invention also provides a method for producing raw paper from the above sheets, the method including:

(a) feeding the pseudostem into the workstation;
(b) supporting the pseudostem for rotation thereof about its longitudinal axis within the workstation;
(c) contacting the rotating pseudostem along substantially its entire length with the fibre-separating device, whereby a continuous sheet is removed from the pseudostem during rotation, the sheet having fibres that are generally parallel in a direction;
(d) laminating two or more sheets together such that the direction of the generally parallel fibres in at least two adjacent sheets is not aligned; and
(e) curing the adjacent sheets to form raw paper.

The sheets produced by the method of the invention are thus continuous sheets removed peripherally from the pseudostems, much as one would peel a layer of paper off a toilet roll. The sheets are continuous in that they are preferably as wide as the pseudostem is long, and they are preferably only as long as is manageable for their subsequent handling. Of course, they will also only be as long as is feasible given the diameter of a particular pseudostem and the desired thickness of the sheet.

GENERAL DESCRIPTION OF THE INVENTION

Throughout this specification, the removal of sheets from a pseudostem will be referred to as a 'separation' process. Indeed, the means defined for removing the sheets from the pseudostem is herein referred to as a fibre-'separating' device. To understand this reference, some explanation of the constitution of a pseudostem is required.

As mentioned above, the pseudostem of a banana plant is not a trunk but is formed by a succession of clasping leaf stalks, having leaves that grow and unfurl at a rapid rate (such as one leaf per week in warmer climates). The leaf-petioles thus eventually form an upright, trunk-like stem that bends without breaking. Before a plant reaches maturity, the pseudostem is comprised only of the leaf-petiole sheaths, and does not include a discernible central portion. As the plant reaches maturity, the core will have commenced formation, as the corm pushes further growth (the shoot apex) up through the central portion. It is this shoot apex that subsequently produces the inflorescence that results in the banana fruit.

Both the sheath portion of the mature pseudostem, and the core portion, are formed from fibres (in bundles) that grow up through the plant during its life. Thus, the fibres are multi strand fibre bundles, which are typically as long as the length of the pseudostem, particularly for those fibres in or near the core. These bundles of fibres are bound together quite strongly, and include within their matrix an appreciable amount of water. Additionally, each bundle of fibres is itself bound tightly with its adjacent bundles, and again the matrix of fibre bundles includes therewithin an appreciable amount of water. It is for this reason that the pseudostems are extremely tough longitudinally and exhibit high levels of flexibility. It is also for this reason that a sheet made in the above manner (and as will be described below) also exhibits high strength at least in the longitudinal direction of the original pseudostem.

Thus, it will be apparent that the fibre-separating device of the present invention does not act to remove sheets by cutting through fibres (as might happen if a traditional veneering process was adopted), but rather removes sheets by virtue of the device being able to move between bundles of fibres (about the periphery of the pseudostem), as the pseudostem rotates, separating them in a manner that retains the integrity of the fibre bundles along virtually the entire length of the pseudostem and thus along the continuously removed sheet. Of course, there may be some inevitable damage to some fibres and some fibre bundles, and some of that damage may be due to the fibre-separating device cutting those fibres and fibre bundles, however this does not detract from the principle aim of there being separation rather than cutting.

Before turning to a more detailed description of the various elements of the method and apparatus of the present invention, it is useful to describe the likely sizing of the pseudostems and the sheets, so as the following description can be read in context. In this respect, it is envisaged that the pseudostems will be pre-processed, prior to being fed to the workstation, so as to have a length in the rather wide range of about 100 mm to about 2.5 m. Ideally, the length will be in the range of about 1.5 m to about 2.0 m, which allows for the apparatus to be reasonably sized, without needing to be too large, and without having to cope with short raw materials that might provide handling difficulties. Therefore, the width of a continuous sheet removed by the method of the invention will also likely be in the range of 1.5 m to 2.0 m.

In relation to the likely length of a sheet, and with reference to the limitation placed on this parameter by the diameter of a pseudostem, the nature and condition of the pseudostem being fed into the workstation must first be explained.

Pseudostems suitable for use with the method of the invention will ideally have, in the raw state, a diameter typically in the range of 200 to 700 mm. Such raw feeds will normally be of varying diameter along their length and will have a relatively rough and irregular exterior, formed by the leaf-petiole sheaths. They will also typically not be perfectly straight lengths, although they will be reasonably flexible and thus will be able to be suitably supported in the workstation so as to be generally straight (in terms of their longitudinal axis) for the purposes of later removing the sheets therefrom (as will be further described below).

The pre-processing of the raw stems may thus include a round-up step where a pseudostem (in a raw state) is fed into a workstation, the pseudostem being supported for rotation thereof about its longitudinal axis, such that a fibre-separating device may be brought into contact with the rotating pseudostem to remove the unwanted rough exterior thereof. Normally, the exterior will not be removed in a manner that would remove a usable sheet therefrom. However, after at least one circumference of the pseudostem has been traversed, there may be a usable sheet removed, depending upon how irregular the exterior was originally.

It should be appreciated that essentially the same apparatus (as will now be described) will be usable for this round-up step, as will be usable for the subsequent processing steps (of the rounded-up pseudostem). There may be different settings required, but this should only require minor modification. For practical operational purposes, and to provide continuous operation, it will likely be prudent however to provide separate apparatus, one to handle the round-up step and one to handle the subsequent processing step.

The pre-processing step will produce a rounded-up pseudostem that will typically be substantially cylindrical, having a regular diameter along its length. It is envisaged that the diameter of the pseudostems, after rounding-up, will be in the range of 150 to 250 mm, although this of course may vary.

It will thus be apparent that the rounded-up pseudostems will be able to produce, if desired, continuous sheets of a predetermined length, when the sheet itself is predetermined to be of a certain thickness. In relation to the preferred sheet thickness, it is envisaged that sheets taken from the core of a pseudostem will be in the order of 0.5 mm to 2.0 mm, whereas sheets taken from the sheath of a pseudostem will be in the order of 2 mm to 10 mm. As will be mentioned below, it should be appreciated that subsequent stages of a process to produce raw paper will, of course, compress these sheets down to more desirable thicknesses.

Noting that there will be an unused core of pseudostem that must remain, which core will typically have a diameter in the range of 15 to 30 mm, it is expected that the continuous sheets will typically be able to have the following maximum lengths:

| Rounded-up diam. (mm) | Sheet thickness (mm) | Sheet Length (m) |
|---|---|---|
| 150 | 0.5 | 35.3 |
| 200 | 0.5 | 62.8 |
| 250 | 0.5 | 98.1 |
| 150 | 1.0 | 17.7 |
| 200 | 1.0 | 31.4 |
| 250 | 1.0 | 49.1 |
| 150 | 2.0 | 8.8 |
| 200 | 2.0 | 15.7 |
| 250 | 2.0 | 24.5 |

With regard to the unused core of the pseudostem remaining (which will hereafter be referred to as the 'core waste'), and now turning to a description of the various elements of the method and apparatus of the present invention, it is preferred that the pseudostem be supported for rotation in the workstation in a manner that both provides the necessary structural support along the length of the pseudostem (being a product that is naturally quite flexible) and also that allows the core waste to be as small as possible. In a preferred form, the support is provided peripherally by one or more rollers arranged to contact the rotating pseudostems, rather than by spindles, spindles being the normal supporting mechanisms used in veneering lathes.

In relation to the provision of necessary structural support, a plurality of support rollers may be configured so as to contact the rotating pseudostems along the full length of the pseudostem. In this respect, multiple support rollers may be provided, such as there being support rollers arranged both underneath and above a rotating pseudostem. In this form, two support rollers may be provided underneath a rotating pseudostem with two or more support rollers also being provided above, or vice-versa. One or more of the support rollers may additionally be a drive roller, and at least some of the rollers may be interconnected or driven by conveyor belts or chains or the like.

In one form, a combination of support rollers and a fixed (non-rotating) support member may be utilised, the support rollers being located above the pseudostem, when the pseudostem is within the workstation, with the fixed support member being located below (thus hereafter referred to as the lower support member). In this form, a conveyor belt or the like will preferably be arranged to travel between the pseudostem and the lower support member to remove the sheet when separated from the pseudostem.

Irrespective of the type of structural support provided, it is preferred to support the pseudostem in a manner that permits a part of the periphery of the pseudostem to undergo planar deformation immediately before contact with the fibre-separating device. Preferably, this planar deformation is such as to allow the fibre-separating device to work on (and thus remove a sheet from) a planar surface of the pseudostem rather than a curved surface, along substantially the entire length of the pseudostem. In this form, surface deformations or irregularities on the pseudostem can be overcome without them interfering with the sheet removal process. Also, consistent sheet thickness is more likely to be achievable with such an arrangement.

In a preferred form, the lower support member will ideally be relatively flat, allowing pressure to be exerted upon the pseudostem by the support rollers from above, to provide this planar deformation and to flatten at least a lower portion of the periphery of the pseudostem as it moves past the lower support member. By arranging the fibre-separating device a predetermined distance above the lower support member, and by ensuring a sufficient pressure from above to deform the periphery of the pseudostem by at least that amount, the above advantages may be achieved.

It will also be appreciated that, as the diameter of the pseudostem decreases during the method, the configuration of the support rollers with respect to each other, and/or a lower support member, and/or with respect to the rotating pseudostem, will need to adjust to the diameter of the remaining pseudostem. Preferably, the adjustment will be such as to continue to present to the fibre-separating device the same non-tangential contact mentioned above, immediately following the portion of planar deformation. Therefore, in another preferred form, one or more of the support rollers/members will need to be positionally adjustable with respect to the rotating stem.

As mentioned above, the removal of the sheets relies upon contacting a rotating pseudostem along substantially its entire length with a fibre-separating device. In one form, the fibre-separating device may be a longitudinally moving blade. Preferably, the blade will be a single, straight blade configured and constrained so as to move substantially parallel to the longitudinal axis of the pseudostem, along the entire length of the pseudostem, in a single pass, the blade itself being at least as long as the pseudostem. In this form, the blade will then move in the opposite direction in a return pass, thus oscillating backwards and forwards along the pseudostem in use. In conjunction with the rotation of the pseudostem, and with the blade being urged against the pseudostem as it oscillates (or the pseudostem being urged against the blade), a sheet is removed from the periphery of the rotating pseudostem in the manner described above.

However, in a more preferred form, the fibre-separating device may be a longitudinally moving blade in the form of a continuous belt, such as is often referred to as a bandsaw blade. Such an arrangement requires the blade to be a flexible endless loop, supported by opposing spaced-apart roller wheels about which the blade is rotated, and configured to present to the rotating pseudostem a separating face on the separating side of the endless loop. By configuring the blade such that the roller wheels are spaced apart by a distance greater than the length of a pseudostem, and by providing a suitable blade support above and below the separating face (leaving at least the leading separating edge exposed), the continuously moving blade acts to continuously remove a sheet off the full length of the rotating pseudostem.

This configuration also advantageously permits the blade to be continuously cleaned (and also continuously sharpened if desired) by providing suitable apparatus in cooperation with the non-separating face (on the blade-return side of the endless loop) of the rotating blade. Thus, in this form, the longitudinally moving blade can be both self-cleaning and self-sharpening.

In this respect, and as mentioned above, the essential characteristic of fibres in a pseudostem is that they exist in bundles, which bundles are generally parallel with the pseudostem's longitudinal axis. However, there will be some bundles that deviate from this alignment, perhaps having some sections of transverse alignment. During the fibre separation process those transverse fibres may be cut and/or may tend to attach to the moving blade, building up on the separating edge and reducing its separating effectiveness. Therefore, it will be quite advantageous to adopt the preferred arrangement of the continuous belt for the longitudinally moving blade, which permits the attached fibres to be removed from the work area so that they can be removed from the blade.

In yet another form, the fibre-separating device may be a laser or high-pressure water system, adapted as appropriate to provide separation of sheets in the manner described above.

Turning now to a description of the raw paper that may be produced using sheets produced by the above method, and the extra method steps required to achieve that, it is important to firstly understand the nature of the sheets being produced.

Depending on their thickness, the sheets removed from the pseudostem will typically comprise a layer of fibre bundles, generally aligned parallel with what was the longitudinal axis of the pseudostem, each bundle extending virtually the entire width of the sheet. A layer might for instance be 10 to 500 bundles thick. These sheets will thus exhibit higher tensile strength (in this longitudinal direction) compared to their lateral strength (in a direction perpendicular to this longitudinal direction).

In relation to the chemical composition of the sheets, immediately after separation from the pseudostem, each sheet will typically contain about 75% water and 25% fibre (by weight) when removed from the pseudostem, and will comprise cellulose in an amount of 55 to 60%, and lignins in an amount of 16 to 20%, with the balance being ash and other materials such as proteins, silica, sugar, fat and some trace elements. It is thus important to note that these sheets thus can be referred to as being comprised of non-wood fibres, an important distinction to make between the fibres found in normal timbers (both in terms of their physical and chemical properties) used to make veneered products, and the fibres in the pseudostems of banana plants.

It has been recognised by the present inventors that it is these physical and chemical properties (mentioned above) of the sheets removed from the pseudostems of banana plants that provide the pseudostem of a banana plant with its high strength and flexibility, and which act to successfully bind together the fibre bundles. Indeed, it has been recognised that the ability of the method and apparatus of the present invention to remove sheets in this manner from the pseudostems allows these properties to be beneficially used in the manufacture of raw paper (and thus various paper and paper products) therefrom, preferably without having to use any added binding chemicals such as adhesives.

Therefore, it is be to understood that the invention extends to a method for producing raw paper from the sheets described above, where that method involves the laminating, and subsequent curing, of two or more sheets, without the use of added chemicals, in a manner such that the fibres in at least two adjacent sheets are not aligned. With regard to terminology, although this specification will refer to the arrangement of two or more sheets together as 'laminating', it is to be understood that this reference does not imply or require the addition of any adhesives or other chemicals for the purposes of bonding—it is simply a reference to a construction made by placing layer upon layer.

The preferred non-alignment of the fibres of adjacent sheets is in order to increase the lateral strength of the laminated product compared to the lateral strength of a single sheet. In this form, the non-alignment may be any suitable degree of non-alignment, such as arranging adjacent sheets so that their respective fibres are essentially perpendicular, to perhaps only a non-alignment of 10° to 15°.

With this in mind, it will be appreciated that raw paper produced using the sheets removed from pseudostems by the method of the present invention may be used for a wide variety of purposes. Indeed, it is envisaged that the raw paper produced will generally be of the same physical characteristics as the raw paper provided as hard rolls by the cellulose fibre pulp/paper industry, and will be able to put to similar uses by paper converters and finishers.

By keeping the integrity of the fibre structure in the raw paper, the raw paper is much stronger in both tension and compression, as well as against repeated bending (folding). The fibres, which are protected in their bundles by a cover of natural lignin, retain their natural water repellent qualities as well as exhibiting a fire retardant characteristic that pulp paper made from stripped cellulose (wood) fibre does not. Therefore, while raw paper made from separated and then laminated sheets of banana fibre can be further finished using the same technology as pulped paper, to substitute for pulped paper, it provides extra advantages and superior qualities.

In relation to the subsequent lamination and curing steps, adopted in order to form two or more sheets into a suitable paper product, any suitable such steps could be utilised, as will be described below in relation to a preferred embodiment. However, it has been found to be particularly advantageous for at least the curing step to apply pressure and heat to the laminated sheets, forcing expulsion of significant amounts of the water therein and reducing the laminated sheet thickness to a suitable raw paper size.

Finally, it will thus be appreciated from the above description that the present invention not only relates to a method of producing sheets, but also to apparatus for producing sheets from the pseudostems of banana plants in the family Musaceae, each pseudostem having a longitudinal axis, the apparatus including:

(a) a workstation into which a pseudostem may be fed;
(b) means for supporting the pseudostem for rotation thereof about its longitudinal axis within the workstation; and
(c) a fibre-separating device for contacting the rotating pseudostem along substantially its entire length;

whereby a continuous sheet of fibre is removed from the pseudostem by the fibre-separating device during rotation.

The present invention thus also provides apparatus for producing raw paper from the above sheets, the apparatus including:

(a) a workstation into which a pseudostem may be fed;
(b) means for supporting the pseudostem for rotation thereof about its longitudinal axis within the workstation;

(c) a fibre-separating device for contacting the rotating pseudostem along substantially its entire length, whereby a continuous sheet is removed from the pseudostem during rotation, the sheet having fibres that are generally parallel in a direction;

(d) means for laminating two or more sheets together such that the direction of the generally parallel fibres in at least two adjacent sheets is not aligned; and (e) means for curing the adjacent sheets to form raw paper.

The present invention also relates of course to the raw paper formed by the methods and apparatus described above.

BRIEF DESCRIPTION OF THE DRAWINGS

An embodiment of the present invention will now be described, by way of example only, with reference to the accompanying drawings. However, it is to be appreciated that the following description only exemplifies one particular way of putting the present invention into practise. The following description is thus not to be read as limiting the above general description.

In the accompanying drawings.

DETAILED DESCRIPTION OF THE PREFERRED EMBODIMENT

Figure 1:
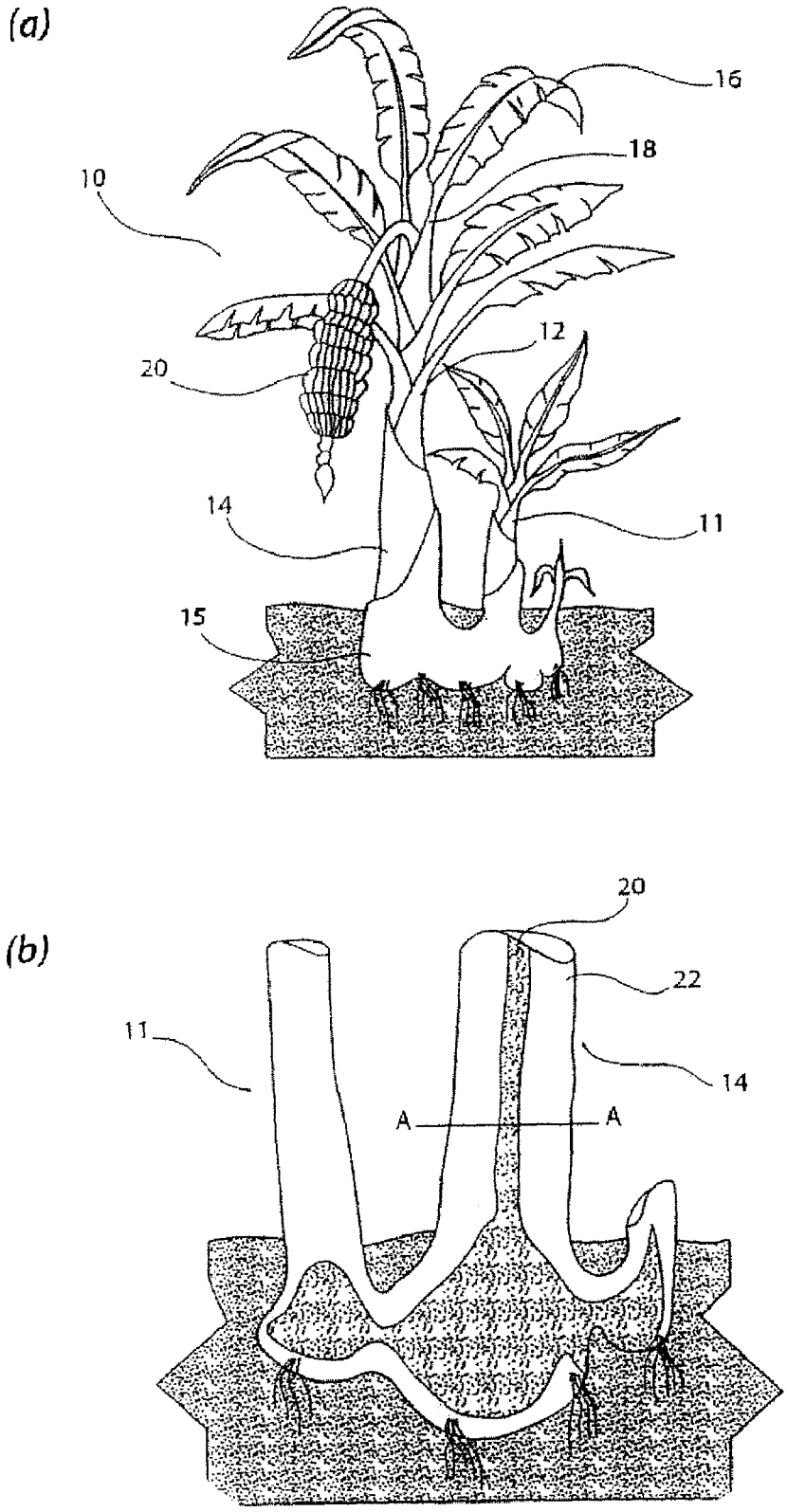
FIG. 1*a* is a schematic side view of a typical banana plant.
FIG. 1*b* is a section through the base of the pseudostem of the banana plant in FIG. 1*a;*
FIG. 1*c* is a section through line A-A of the pseudostem in FIG. 1*b;*
FIG. 1*d* is the same section as FIG. 1*c*, but after the psuedostem has been rounded-up.
Figure 1:
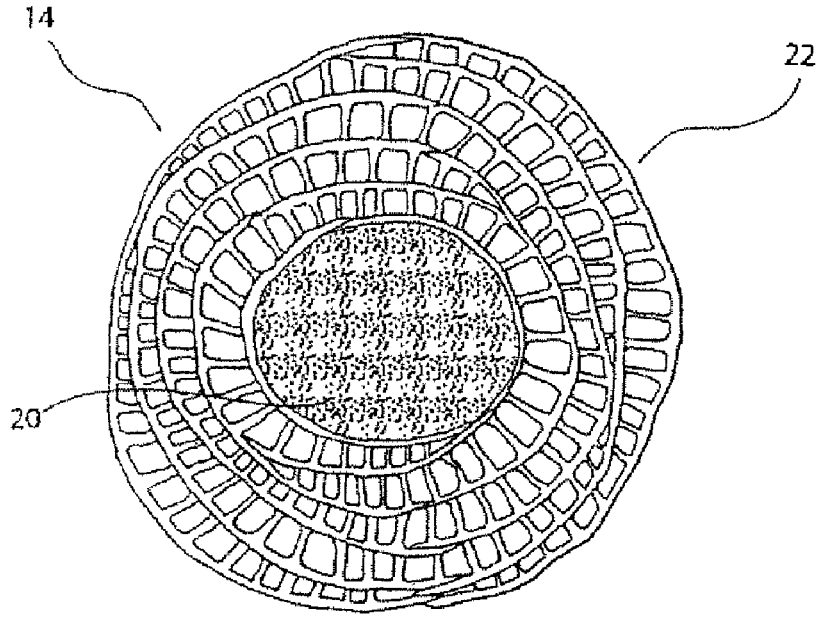
Figure 1:
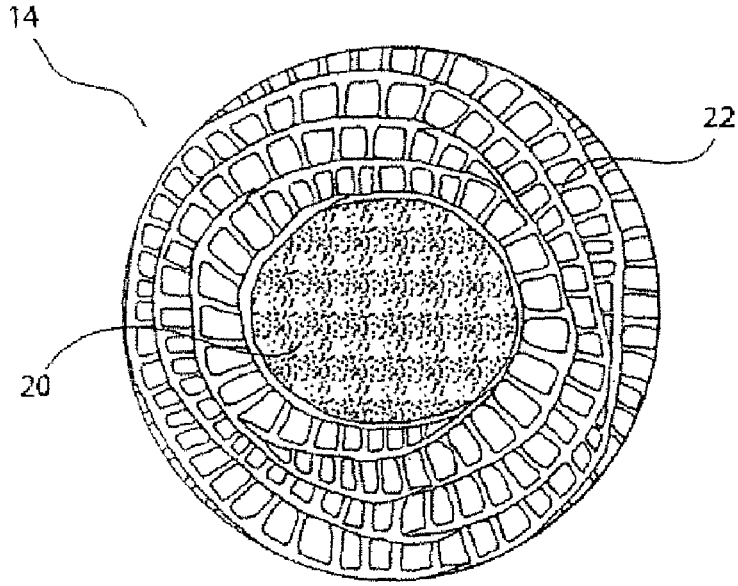

Before turning to a more detailed description of the apparatus illustrated in FIGS. 2 to 7, it is helpful to firstly illustrate various aspects of the raw feed material for the subject of this invention. FIG. 1*a* shows a typical banana plant 10 (with a sucker 11), being a large perennial herb with leaf-petiole sheaths 12 that form a generally cylindrical, trunk-like pseudostem 14. Each pseudostem grow's from a bud on the corm 15, which is an underground rhizome. The banana plant 10 can grow to heights normally in the range of 3 to 8 meters over a 9 to 18 month period.

Tender, smooth, fleshy-stalked leaves 16, numbering from about four to about fifteen, are arranged spirally on leaf stalks 18 extending from the leaf-petioles sheaths 12. The inflorescence, a transformed growing point, is a terminal spike shooting out from the heart in the tip of the pseudostem 14, emanating from the core 22 illustrated in FIG. 1*b*. As the young fruits develop from the female flowers, they appear as green slender fingers. The bracts then shed and the fully-grown fruits in each cluster become a 'hand' of bananas 20, with the stalk drooping until the bunch hangs upside down.

The pseudostem 14 of a mature plant has an outer layer 22 that is formed by the leaf-petiole sheaths as the plant grows, that is distinct from the core 20 as is evident from the typical section of a raw pseudostem 14 (before the round-up process) illustrated in FIG. 1*c*. As can also be seen in FIG. 1*b*, an immature pseudostem (such as sucker 11) does not yet have a core and thus is entirely formed from this sheath material.

Commercially planted banana plants typically only have 1 to 2 year life spans, as banana plants only flower (and produce bananas) once, following which the leaves, leaf stalks and pseudostem start to die. The pseudostem may then be used in a method such as that of the present invention.

Once the fruit have been removed from a banana plant, its pseudostem is available for use. Ideally, each pseudostem will be cut to a suitable length, and will undergo a pre-processing step that has been referred to above as a "round-up step". For present purposes, the pre-processing will be conducted in the same manner, and with the same method and apparatus as the primary processing step, and thus the description of the preferred embodiment will now turn to a description of a single apparatus and its method of operation.

Figure 2:
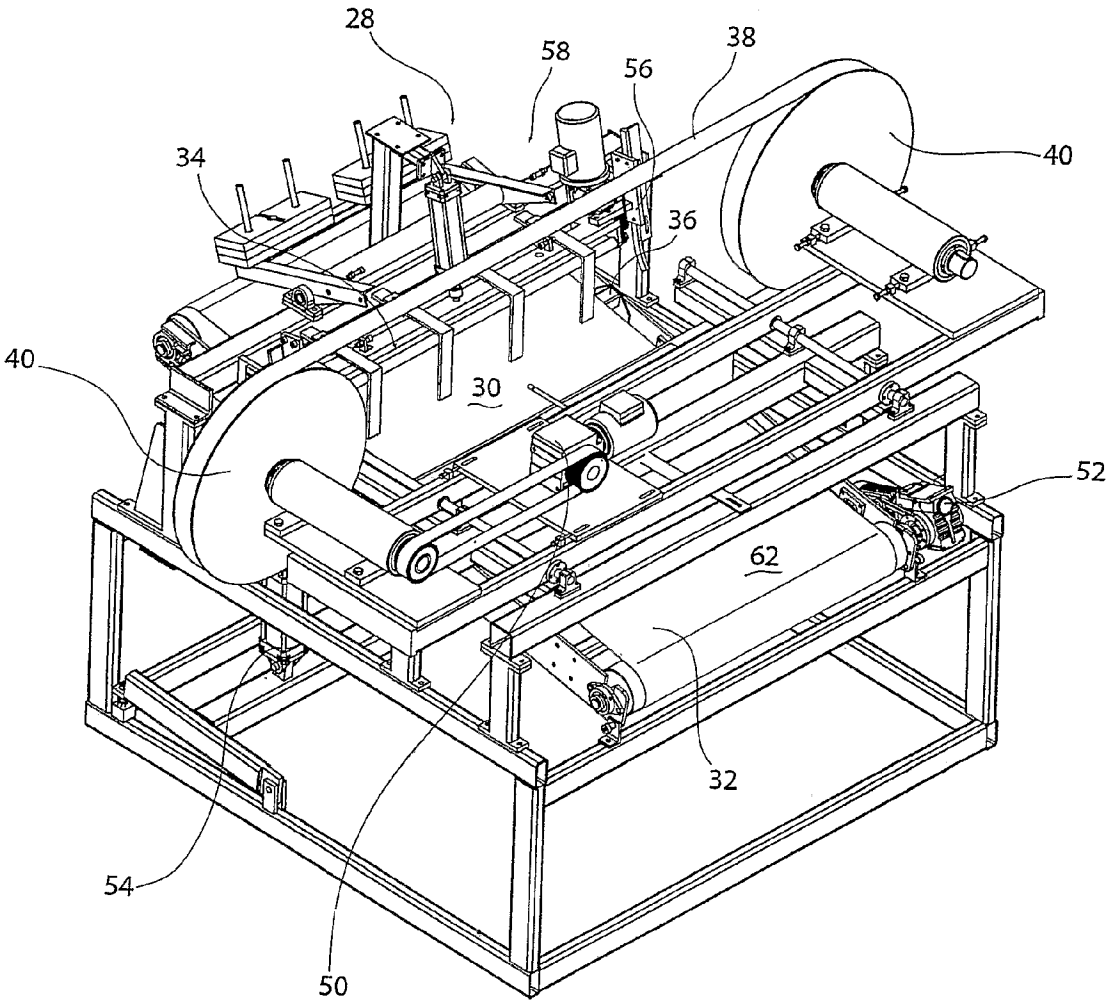
FIG. 2 is a perspective view of an apparatus in accordance with a preferred embodiment of the present invention.
Figure 3:
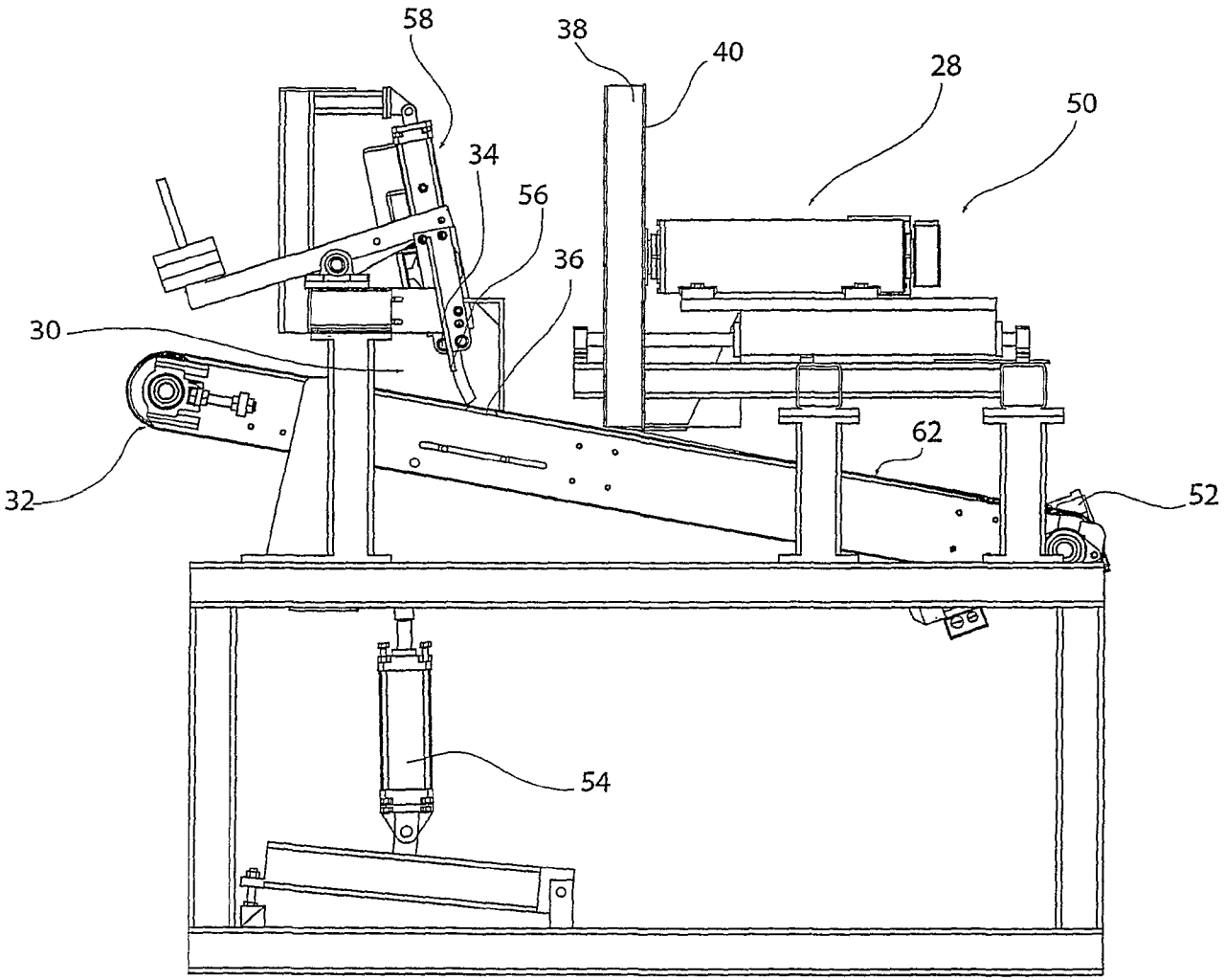
FIG. 3 is a schematic end view of the apparatus of FIG. 2.
Figure 4:
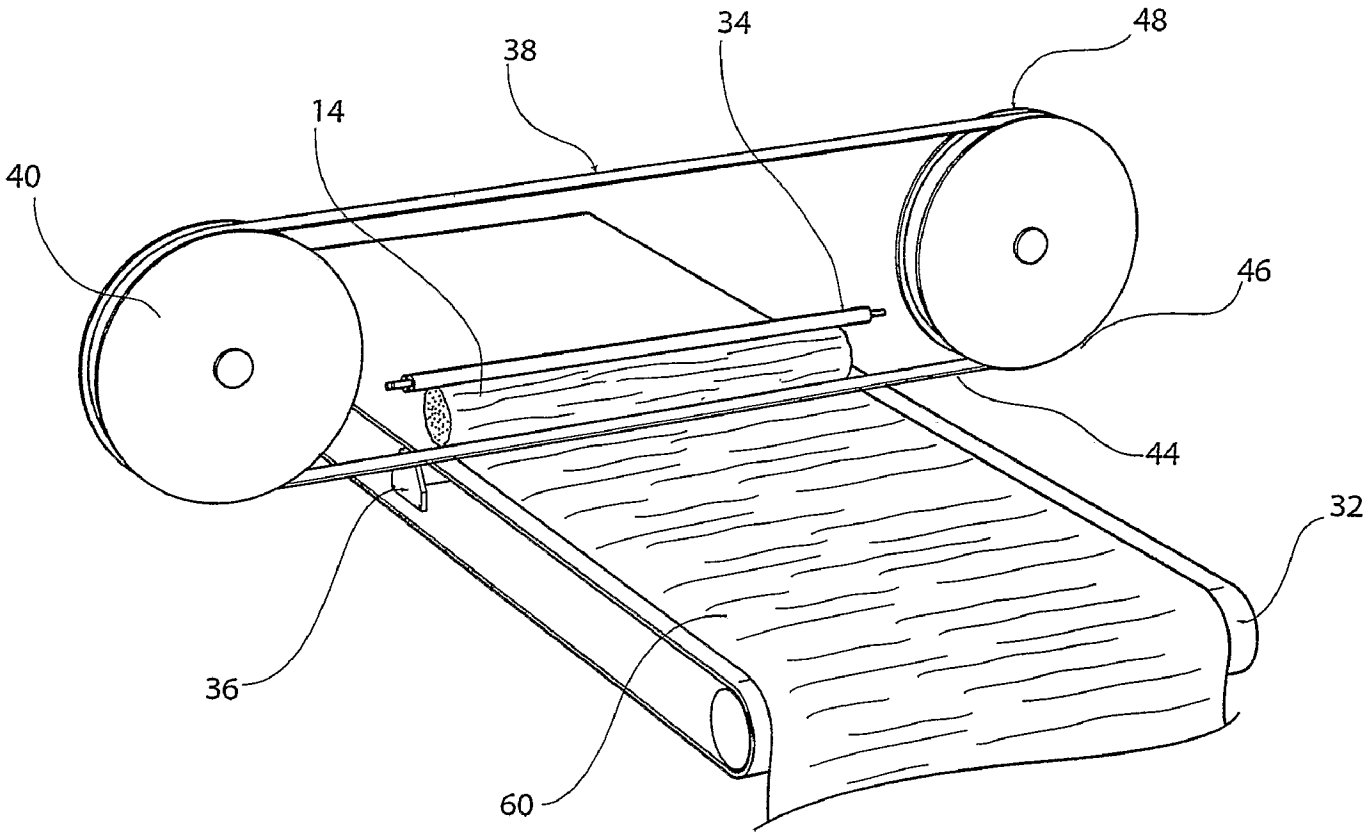
FIG. 4 is a schematic cut-away view of the apparatus of FIG. 2, showing the relationship of the pseudostem to the fibre-separating device and the support rollers/members whilst within the workstation.

Illustrated in FIGS. 2, 3 and 4 is an apparatus 28 that is capable of producing sheets 60 from the pseudostems 14 of banana plants. Referring only to those parts of the apparatus that require some explanation, the apparatus 28 generally includes a workstation 30 that is an area above a conveyor mechanism 32 and below supporting rollers 34 (that will be described in more detail below). The position of a pseudostem 14 is also supported upon the conveyor mechanisms 32 by the presence of a fixed (non-rotating) support member (the lower support member) in the preferred form of an elongate deadplate 36. While in this embodiment the support beneath the workstation 30 is provided by a fixed (non-rotating) support member, it must be appreciated that this support may alternatively be provided by a suitably configured and sized rotating roller.

In relation to the workstation 30, it will be appreciated that the apparatus illustrated in FIG. 2 has had the pseudostem 14 removed therefrom, for the sake of clarity of the illustration.

The apparatus 28 includes a fibre-separating device in the form of a longitudinally moving blade 38 that is configured and constrained so as to move substantially parallel to the longitudinal axis of the pseudostem 14, along its entire length, in a single pass. It will therefore be apparent that the pseudostem 14 will be of a length to fit within the workstation 30 generally between the spaced apart roller wheels 40 of the fibre-separating device. In relation to these roller wheels 40, it will be apparent that the preferred form of longitudinally moving blade 38 is that of a continuous belt, such as is often referred to as a bandsaw blade.

The blade 38 presents to the rotating pseudostem 14 a separating face 44 (most evident in FIG. 4) on the separating side 46 of the blade 38. In this respect, the other side of the blade 38 can be referred to as a return side 48. As is evident in FIG. 3, the bandsaw blade 38 is supported by a suitable blade support 42 above and below the blade 38. The blade support 42 may include a blade cleaning means (not shown) that is capable of continuously cleaning the blade during operation.

The apparatus 28 generally includes means 50 for driving and controlling the longitudinally moving blade 38, means 52 for driving and controlling the conveyor mechanism 32, and an actuating means 54 that is able to tilt the conveyor mechanism 32 as required. In this respect, the lowering of the conveyor mechanism 32 allows the feeding of a new pseudostem 14 into the workstation 30 and also allows for the removal of a waste core therefrom at the end of the operation.

Figure 5:
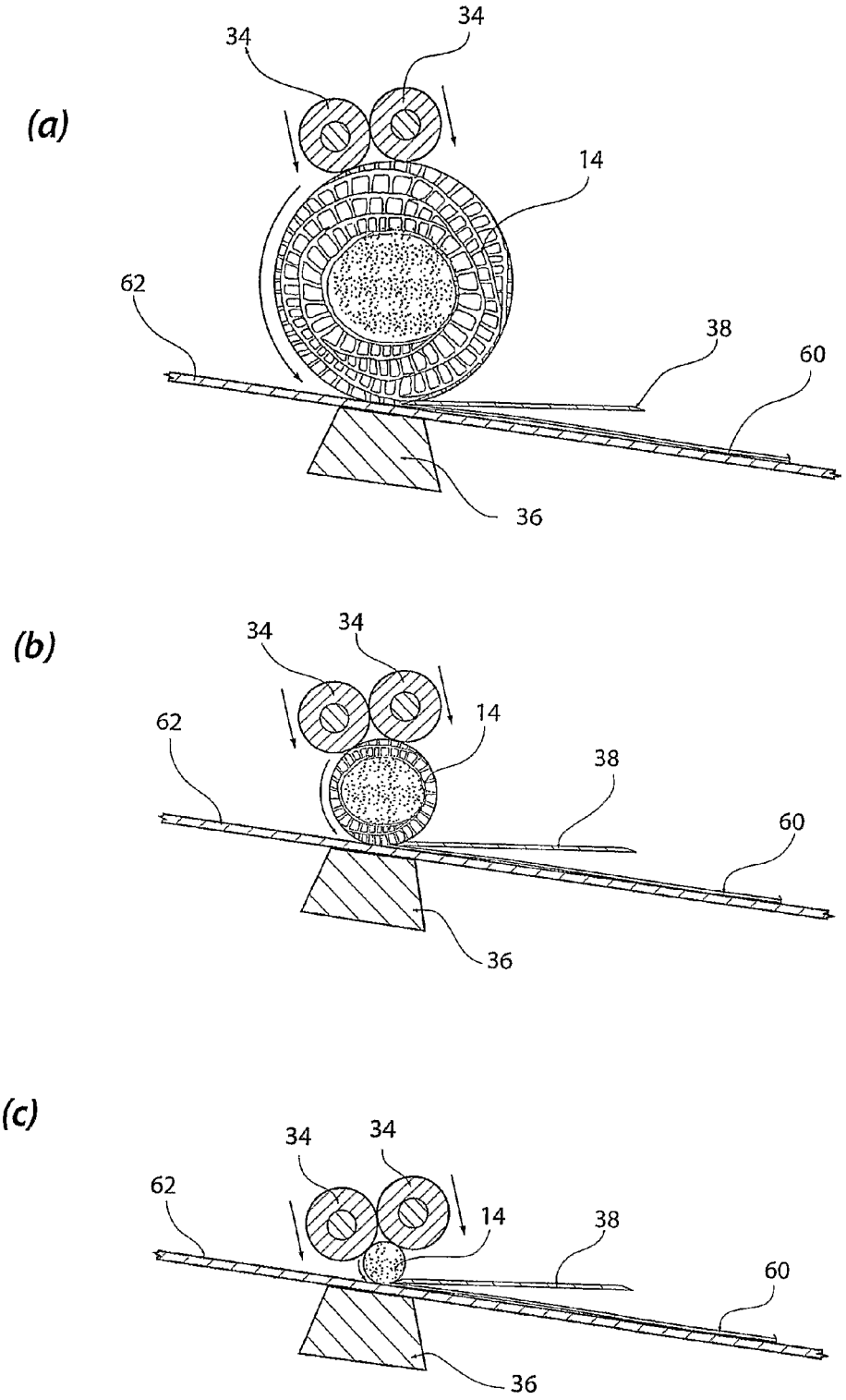
FIGS. 5*a*, 5*b* and 5*c* are successive operational views of a pseudostem in the workstation, as the diameter of the pseudostem reduces.

Additionally, the apparatus 28 includes a guide means 56 that is able to provide positional adjustment of the support rollers 34 during operation of the method, as will be described below in relation to FIGS. 5 and 6. Associated with the guide means 56 is an actuating and drive member 58 that allows pressure to be exerted on the support rollers 34, and subsequently upon the pseudostem 14 when in workstation 30, whilst also applying drive to one or both of the support rollers 34.

Turning now to a discussion of FIGS. 5*a*, 5*b*, and 5*c*, these Figures show sequentially the operation of the apparatus 28 in terms of a pseudostem 14. FIG. 5*a* shows the pseudostem 14 having a diameter of about 150 mm, which is a typical starting diameter for a rounded-up pseudostem fed into the workstation 30. FIG. 5*b* shows the pseudostem 14 after it has been operated upon for some time, and after a continuous sheet 60 has been separated therefrom, the pseudostem 14 now having a reduced diameter of about 75 mm. FIG. 5*c* show the pseudostem 14 at a further reduced diameter of about 25 mm; which is a diameter equivalent to the smallest diameter envisaged, which would then equate to the waste core to be removed.

Also shown in FIGS. 5*a*, 5*b*, and 5*c* is the conveyor belt 62 upon which the pseudostem 14 will rest, supported thereunder by the support member 36. The support rollers 34 are also evident.

In relation to the progression from the situation in FIG. 5*a*, to the situation in FIG. 5*b* and subsequently to the situation in FIG. 5*c*, reference is also made to FIG. 6. Together these drawings show that, as the diameter of the pseudostem 14 decreases, the configuration of the support rollers 34 with respect to each other, and with respect to the lower support member 36, adjust to the diameter of the remaining pseudostem. This adjustment tends to result in the principal contact point of the pseudostem 14 with the conveyor belt 62 following the path indicated by line A in FIG. 6. In this respect, the guide means 56 is able to be configured to provide positional adjustment of this type by guiding the location of the support rollers 34 in relation to the pseudostem 14.

Figure 6:
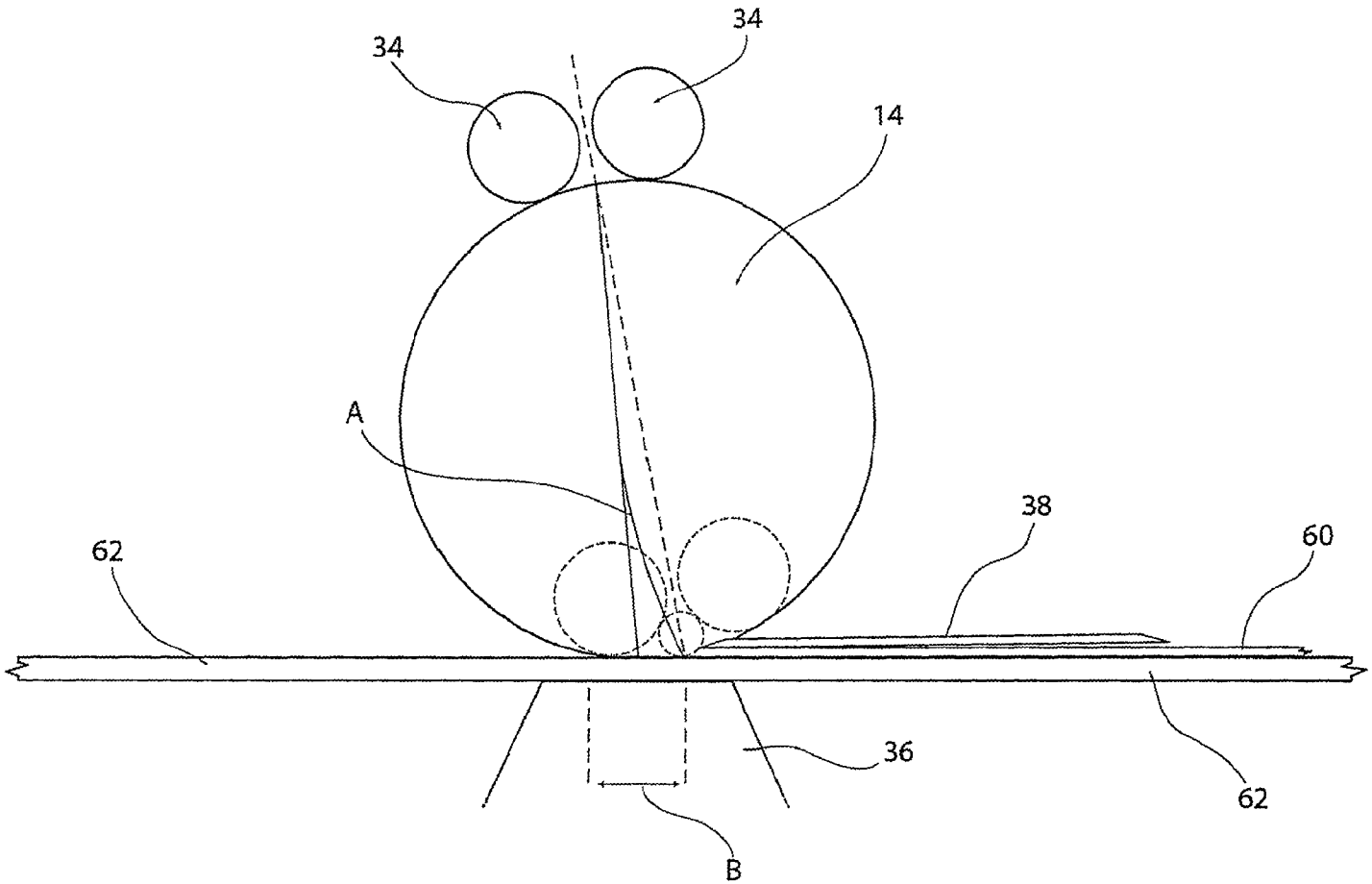
FIG. 6 is an operational view showing the preferred support roller movement during the operation illustrated in FIGS. 5*a*, 5*b* and 5*c*.

It is also apparent from the illustration in FIG. 6 that, with the lower support member 36 having a flat upper surface, the pressure exerted upon the pseudostem 14 by the support rollers 34 from above causes a part of the periphery of the pseudostem (indicated by the portion B in FIG. 6) to undergo planar deformation immediately before contact with the fibre-separating device. It is this planar deformation that allows the fibre-separating device to work on a planar portion of the pseudostem rather than a curved portion, which is of assistance in removing a sheet of constant thickness. Also, by arranging the fibre-separating device (namely the blade 38) a pre-determined distance above the conveyor belt 62, a sheet 60 of a pre-determined thickness may be separated therefrom.

In this form, surface deformations or irregularities on the pseudostem can be overcome without them interfering with the sheet removal process, as a portion of constant planar section is continuously presented to the separating surface of the blade 38.

The surface of the support rollers 34 is preferably smooth so as not to mark the surface of the pseudostem 14 (and thus subsequently damage a sheet to be removed). Ideally, the support rollers 34 will be a polished steel. Indeed, ideally the upper surface of the support member 36 will also be polished to allow relatively frictionless passage thereover of the conveyor belt 62, even when the pseudostem 14 is under the pressure required to create the planar deformation mentioned above.

Use of the apparatus 28 on a suitably sized pseudostem 14 results in the removal from the pseudostem 14 of a continuous sheet 60 of fibre, a sheet that is as wide as the pseudostem 14 is long, and is as long as is dictated by the desired thickness of the sheet 60 and the starting diameter of the pseudostem 14. This sheet 60 will be continually removed from the apparatus 28 by the conveyor belt 62. The sheet will be continuous to a point where the minimum workable diameter of the pseudostem 14 is reached, following which the waste core will be removed from the apparatus 28, to be replaced by a new raw pseudostem. In this respect, and referring again to the use of such apparatus for both the round-up (pre-processing) step and also the primary processing step, it will be appreciated that the first few rotations of a raw pseudostem (in the round-up process), such as the pseudostem shown in FIG. 1*c*, will not likely result in sheet that will be usable. However, it is envisaged that after only one or two traverses of the pseudostem, to produce a rounded-up pseudostem of the type shown in FIG. 1*d*, a continuous sheet will be produced.

Figure 7:
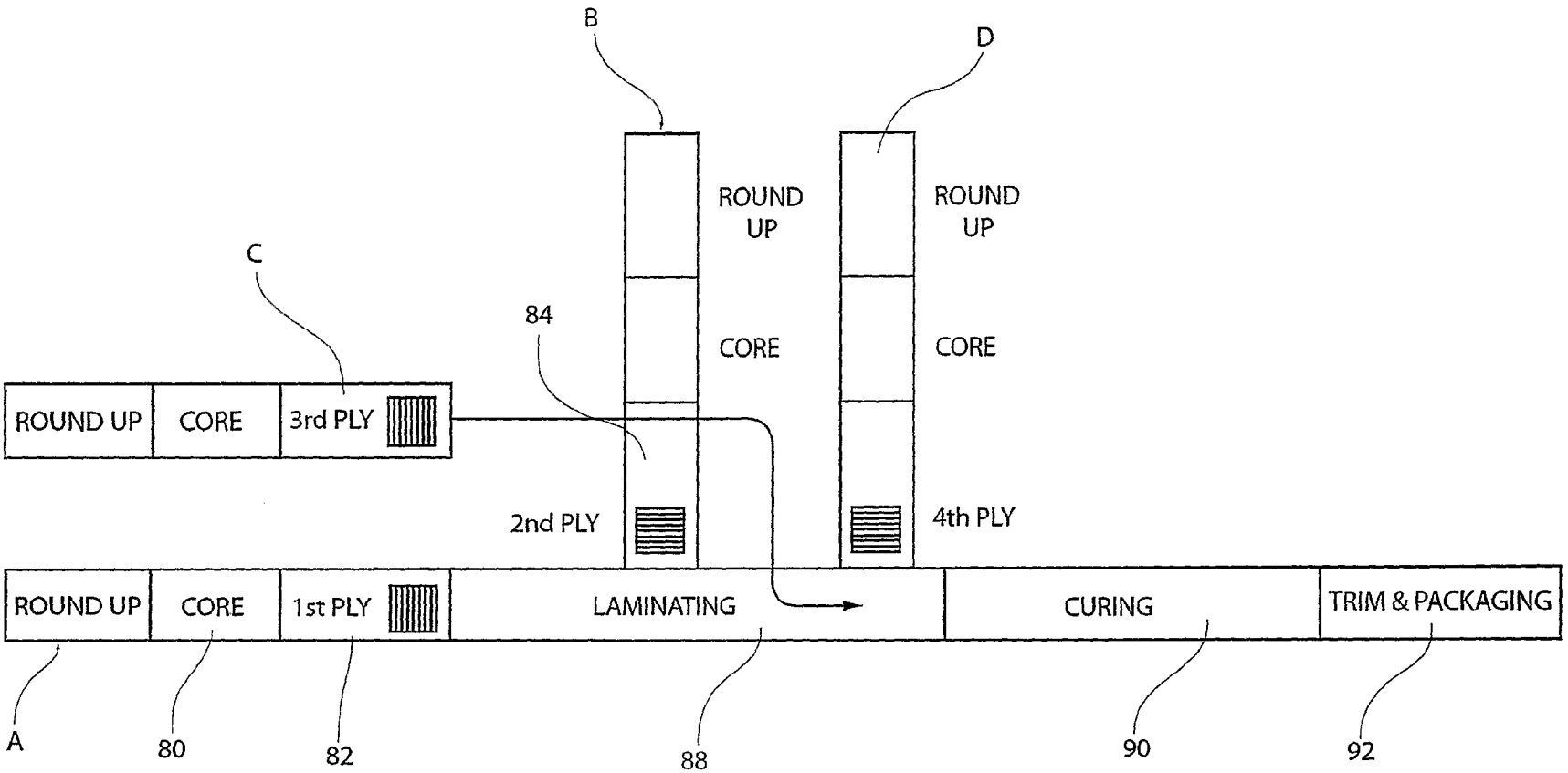
FIG. 7 is a flow chart showing the arrangement and layout of a method of producing raw paper, using the apparatus of FIG. 2.

In relation to the arrangement of a suitable overall operation, one which is capable of producing raw paper therefrom, ready to be forwarded to paper converters in the normal manner, reference is made to FIG. 7.

FIG. 7 is a diagrammatic flow diagram showing a proposed operation that is able to produce raw paper from two, three, or four sheets. In this respect, a first apparatus 80 (such as the apparatus 28 described above) is located in line A to produce a first sheet having a first fibre alignment, referred to as first ply 82. The second line B that also includes an apparatus 28 of the type described above, namely apparatus 84 produces a second sheet (referred to as second ply 86) having its fibres (being the longitudinal fibres from the original pseudostem) arranged perpendicularly to the fibres of the first sheet.

The laminating process 88 is one that allows those two sheets (namely the first ply 82 and the second ply 86) to be placed one on top of the other with the fibres non-aligned to produce a dual layer sheet.

As can be seen from FIG. 7, third and fourth lines, C and D, may also be introduced to produce further sheets to be layered therefore producing either three or four layer sheets.

The laminated material is then processed through a suitable curing step 90 that applies suitable pressure and temperature to compress the layered material, to form a raw paper product of a suitable thickness, having suitable characteristics. The final raw paper may then be trimmed and packaged as necessary in stage 92.

It can thus be seen that the method and apparatus of the present invention is able to separate fibres from a bulk pseudostem in a manner that results in relatively thin sheets of fibre, each sheet having a series of fibres (or bundles of fibres) arranged in a single direction, that can each then be laminated to another sheet, with the fibres running in a different direction, to ultimately produce raw paper. The method does not require the use of additional chemicals to bond the different sheets together, nor does it require the removal of the chemicals naturally occurring in the pseudostem. Rather it relies on the natural bonding characteristics of the normal composition of a banana pseudostem.

The apparatus is able to separate and remove these sheets from the pseudostem in a manner that copes with the flexible nature of the pseudostem, and also takes account of the fact that the composition of the pseudostem tends to jam and foul a more traditional veneering type operation. Indeed, given the nature and composition of banana pseudostems, it is not possible to apply traditional veneering techniques to cut veneers from a banana pseudostem.

Finally, it will be appreciated that this embodiment has been described by way of example only, and that variations and modifications within the spirit and scope of the invention are also envisaged.

The invention claimed is:

1. Apparatus for producing sheets from the pseudostems of banana plants in the family Musaceae, each pseudostem having a longitudinal axis, the apparatus including:

(a) a workstation configured to receive a pseudostem;

(b) supporting means for supporting the pseudostem for rotation thereof about its longitudinal axis within the workstation; and (c) a fibre-separating device comprising a longitudinally moving blade for contacting the pseudostem along substantially its entire length;

whereby a continuous sheet of fibre is removed from the pseudostem by the fibre-separating device during rotation.

2. Apparatus according to claim 1, wherein the supporting means is provided about the periphery of the pseudostem by one or more rollers arranged to contact the rotating pseudostems.

3. Apparatus according to claim 2, wherein a plurality of support rollers are configured so as to contact the rotating pseudostems along the full length of the pseudostem.

4. Apparatus according to claim 3, wherein support rollers are arranged both underneath and above a rotating pseudostem.

5. Apparatus according to claim 2, wherein one or more of the support rollers act as a drive roller.

6. Apparatus according to claim 1, wherein the supporting means is a combination of support rollers and a fixed, non-rotating support member, the support rollers being located above the pseudostem, when the pseudostem is within the workstation, with the fixed support member being located below.

7. Apparatus according to claim 6, wherein a conveyor belt is arranged to travel between the pseudostem and the lower support member to remove the sheet separated from the pseudostem.

8. Apparatus according to claim 1, wherein the support means is configured to support the pseudostem such that part of the periphery of the pseudostem undergoes planar deformation immediately before contact with the fibre-separating device.

9. Apparatus according to claim 8, wherein the planar deformation is such as to allow the fibre-separating device to remove a sheet from a planar surface of the pseudostem along substantially the entire length of the pseudostem.

10. Apparatus according to claim 6, wherein the fixed support member is relatively flat, allowing pressure to be exerted upon the pseudostem by the support rollers from above, to provide planar deformation and to flatten at least a lower portion of the periphery of the pseudostem as it moves past the fixed support member.

11. Apparatus according to claim 10, wherein the fibre-separating device is arranged to be a predetermined distance above the fixed support member.

12. Apparatus according to claim 1, wherein the supporting means is positionally adjustable with respect to the rotating stem.

13. Apparatus according to claim 1, wherein the blade is a single, straight blade configured and constrained so as to move substantially parallel to the longitudinal axis of the pseudostem, along the entire length of the pseudostem, in a single pass, the blade being at least as long as the pseudostem.

14. Apparatus according to claim 13, wherein the blade can move in the opposite direction in a return pass, thus oscillating backwards and forwards along the pseudostem in use.

15. Apparatus according to claim 13, wherein the fibre-separating device is a longitudinally moving blade in the form a continuous belt.

16. Apparatus according to claim 15, wherein the blade is a flexible endless loop, supported by opposing spaced-apart roller wheels about which the blade is rotated, and configured to present to the rotating pseudostem a separating face on a separating side of the endless loop.

17. Apparatus according to claim 16, wherein the blade is configured such that the roller wheels are spaced apart by a distance greater than the length of a pseudostem, and a suitable blade support is provided above and below the separating face, leaving at least a leading separating edge exposed, such that the continuously moving blade acts to continuously remove a sheet off the full length of the rotating pseudostem.

18. Apparatus according to claim 16, including a blade cleaning apparatus in cooperation with the non-separating face of the rotating blade, positioned on the blade-return side of the endless loop.

* * * * *